US010033144B1

(12) United States Patent
Patterson

(10) Patent No.: US 10,033,144 B1
(45) Date of Patent: Jul. 24, 2018

(54) ELECTRICAL OUTLET HAVING ROTATABLE RECEPTACLES

(71) Applicant: Brenda Patterson, Hampton, TN (US)

(72) Inventor: Brenda Patterson, Hampton, TN (US)

( * ) Notice: Subject to any disclaimer, the term of this patent is extended or adjusted under 35 U.S.C. 154(b) by 0 days.

(21) Appl. No.: 15/807,113

(22) Filed: Nov. 8, 2017

(51) Int. Cl.
*H01R 39/00* (2006.01)
*H01R 35/02* (2006.01)
*H01R 25/00* (2006.01)

(52) U.S. Cl.
CPC ..... *H01R 35/02* (2013.01); *H01R 25/006* (2013.01)

(58) Field of Classification Search
CPC ..... H01R 35/04
USPC ..... 439/11, 13, 640
See application file for complete search history.

(56) References Cited

U.S. PATENT DOCUMENTS 5,350,310 A * 9/1994 Chen ..... H01R 13/71 200/51.09
5,429,518 A * 7/1995 Chen ..... H01R 13/71 200/51.09
5,484,299 A * 1/1996 Schlessinger ..... H01R 13/4532 200/51.1
5,967,815 A * 10/1999 Schlessinger ..... H01R 29/00 200/51.09
6,013,467 A * 1/2000 Siedel ..... C12Q 1/00 435/15
6,015,307 A * 1/2000 Chiu ..... H01R 13/71 200/51.09
6,196,851 B1 * 3/2001 Gerard ..... H01R 35/04 439/20
6,638,074 B1 * 10/2003 Fisher ..... H01R 35/04 439/18
6,750,410 B2 * 6/2004 Lee ..... C08J 9/0004 200/51 R
7,121,834 B2 * 10/2006 Gerard ..... H01R 35/04 439/21
7,125,257 B1 * 10/2006 Liang ..... H01R 35/04 439/22
7,497,740 B2 * 3/2009 Mei ..... H01R 13/514 200/51 R
7,500,854 B2 * 3/2009 Gottstein ..... H01R 25/006 439/13
7,540,768 B1 * 6/2009 Wang ..... H01R 13/743 439/536
7,753,682 B2 * 7/2010 Gerard ..... H01R 13/652 439/13

(Continued)

*Primary Examiner* — Neil Abrams
(74) *Attorney, Agent, or Firm* — Golf Coast Intellectual Property Group

(57) ABSTRACT

An electrical outlet that is configured with rotating receptacles so as to facilitate the accommodation of large electrical plugs simultaneously. The electrical outlet includes a housing having a plurality of walls configured to form an interior volume. A first receptacle and a second receptacle are rotatably secured on the front wall of the housing. The first receptacle and the second receptacle include rotation rings having a plurality of notches circumferentially formed thereon. A plurality of keepers are present and are operable to engage the rotation rings. The first receptacle and the second receptacle include connection assembly that are configured to electrically couple the first receptacle and second receptacle to a conducting bar disposed at the rear of the housing. The connection assemblies include a union manufactured from copper.

20 Claims, 2 Drawing Sheets

(56) References Cited

U.S. PATENT DOCUMENTS

| | | | | |
|---|---|---|---|---|
| 7,824,185 | B2 * | 11/2010 | Chien | H04N 5/2354 439/11 |
| 8,011,930 | B2 * | 9/2011 | Lee | H01R 13/6675 439/18 |
| 9,124,056 | B1 * | 9/2015 | Lewis, Jr. | H01R 39/64 |
| 9,502,808 | B1 * | 11/2016 | Baldwin | H01R 35/04 |
| 9,660,394 | B2 * | 5/2017 | Zien | H01R 13/7135 |
| 9,716,362 | B2 * | 7/2017 | Liang | H01R 35/04 |
| 9,728,908 | B1 * | 8/2017 | Baldwin | H01R 13/71 |
| 9,735,492 | B2 * | 8/2017 | Shum | H01R 35/04 |
| 2002/0182910 | A1 * | 12/2002 | Kiughadush | H01R 24/76 439/171 |
| 2013/0027856 | A1 * | 1/2013 | Tai | F16M 11/041 361/679.01 |

* cited by examiner

ELECTRICAL OUTLET HAVING ROTATABLE RECEPTACLES

FIELD OF INVENTION

The present invention relates generally to electrical outlets, more specifically but not by way of limitation, an electrical outlet having a first receptacle and a second receptacle wherein the first receptacle and the second receptacle are rotatable so as to accommodate a large plug in both the first receptacle and second receptacle simultaneously.

BACKGROUND

Electrical outlets are well known in the art. Conventional electrical outlets are typically configured with a first receptacle and a second receptacle wherein the first receptacle and second receptacle are typically vertically aligned on the receptacle. The first receptacle and second receptacle typically include three apertures configured to receive a portion of an electrical plug therein. The three apertures include a hot supply, a return and a ground wherein the hot supply and the return are typically adjacent to each other and parallel.

One issue with conventional electrical outlets is the inability to accommodate larger electrical plugs in both the first receptacle and second receptacle simultaneously. Many electrical plugs often have a body with a perpendicular portion that extends downward into the cord. When this style of plug is placed into a receptacle, the ability to connect another plug into the additional receptacle is removed. Additionally, the conventional arrangement of a conventional electrical outlet renders a lower receptacle inaccessible if the large plug is inserted into the upper receptacle.

Accordingly, there is a need for an electrical outlet that is configurable to accommodate a large plug in the first receptacle and second receptacle simultaneously.

SUMMARY OF THE INVENTION

It is the object of the present invention to provide an electrical outlet that is configured to accommodate a large electrical plug in both the first receptacle and the second receptacle wherein the electrical outlet of the present invention includes a first receptacle and a second receptacle wherein the first receptacle and second receptacle are rotatable.

Another object of the present invention is to provide an electrical outlet having rotatable first and second receptacles wherein the first and second receptacle include outer rings configured to provide controlled incremental rotational movement.

A further object of the present invention is to provide an electrical outlet that is configured to accommodate a large electrical plug wherein the first receptacle includes a wiring configuration having a union located posteriorly of the first receptacle.

Yet a further object of the present invention is to provide an electrical outlet that is configured to accommodate a large electrical plug wherein the second receptacle includes a wiring configuration having a union located posteriorly of the second receptacle.

Still another object of the present invention is to provide an electrical outlet having rotatable first and second receptacles wherein the wiring configurations for the first receptacle and the second receptacle are rigid and rotatable so as to move in conjunction with the first and second receptacle.

An additional object of the present invention is to provide an electrical outlet that is configured to accommodate a large electrical plug in both the first receptacle and the second receptacle that further includes a conducting bar locating at the rear of the electrical outlet.

Yet a further object of the present invention is to provide an electrical outlet having rotatable first and second receptacles that further include a first coupling and a second coupling electrically coupled with the conducting bar wherein the first coupling and second coupling are electrically coupled to the unions of the wiring configurations for the first receptacle and the second receptacle.

Another object of the present invention is to provide an electrical outlet that is configured to accommodate a large electrical plug in both the first receptacle and the second receptacle that further include retaining tabs configured to secure the first receptacle and second receptacle in position subsequent rotation thereof.

An alternate object of the present invention is to provide an electrical outlet having rotatable first and second receptacles wherein the outlet is provided in a self-contained electrical junction box.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
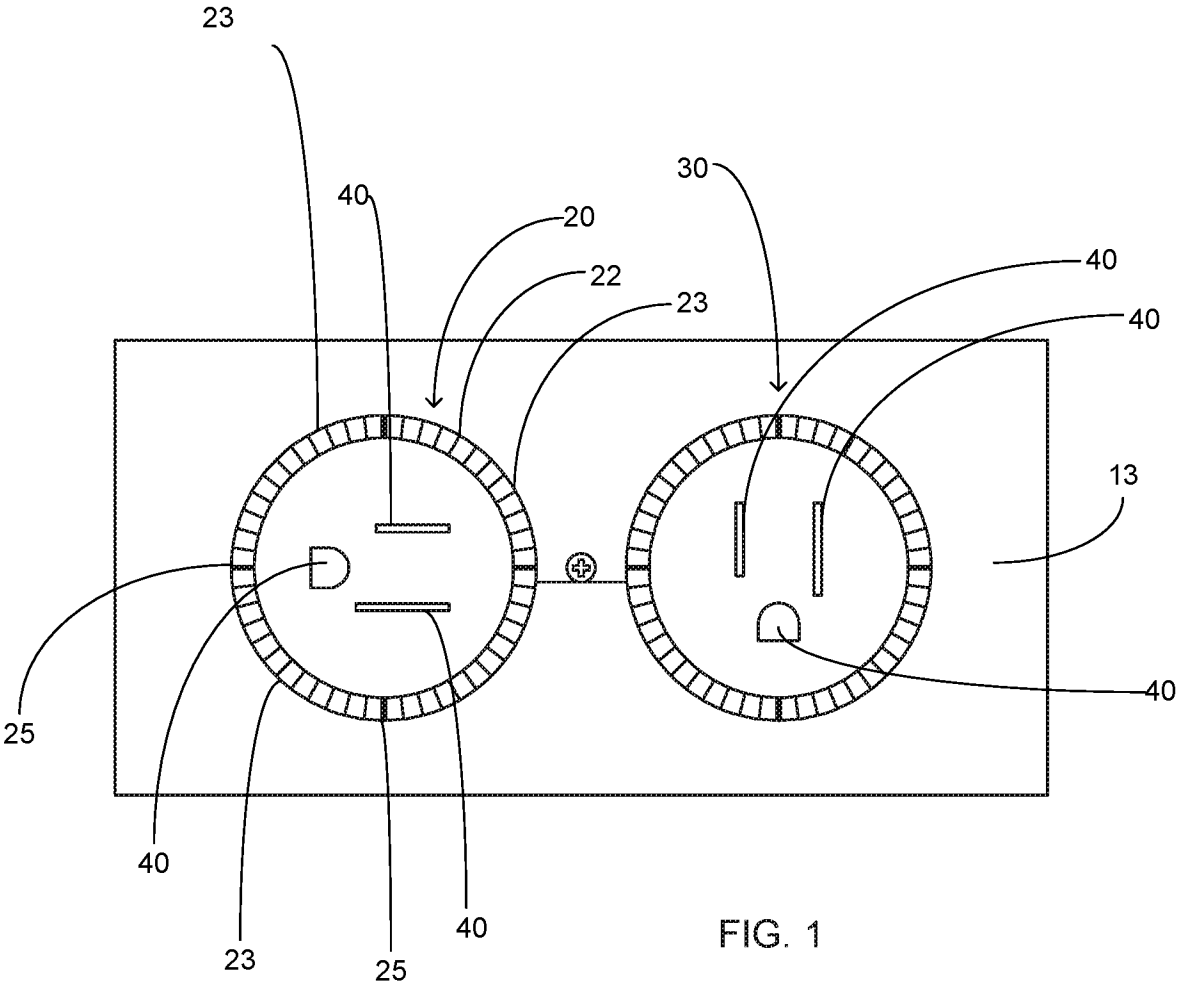
FIG. 1 is a front view of an embodiment of the present invention.

Referring now to the drawings submitted herewith, wherein various elements depicted therein are not necessarily drawn to scale and wherein through the views and figures like elements are referenced with identical reference numerals, there is illustrated an electrical outlet 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the electrical outlet 100 includes a housing 10 that is manufactured from a suitable durable material such as but not limited to plastic. The housing 10 includes a plurality of walls 11 that are integrally formed to create and interior volume 12. While the housing 10 is illustrated herein as being rectangular in shape it is contemplated within the scope of the present invention that the housing 10 could be formed in alternate shapes and sizes.

Operably coupled to the front wall 13 of the housing 10 are the first receptacle 20 and second receptacle 30. The first receptacle 20 and second receptacle 30 are rotatably mounted to the front wall 13 so as to facilitate the acceptance of large plugs that may block the adjacent receptacle if the first receptacle 20 and second receptacle 30 are positioned in the same orientation. The first receptacle 20 include rotation ring 22 circumferentially disposed therearound. The rotation ring 22 includes a plurality of notches 23 formed therein. The first receptacle 20 further includes a plurality of keepers 25 surroundably present on thereon. The keepers 25 are configured to engage notches 23 and execute two functions as a result of the engagement. First the keepers 25 provide an incremental fixed rotational movement through the frictional engagement with the notches of the rotation ring 22. As a user rotatably moves the first receptacle 20 in either a clockwise or counterclockwise direction, the engagement of the keepers 25 with the notches 23 provide a controlled incremental movement to the rotation. Ensuing the first receptacle 20 being rotated to its desired position, the engagement of the keepers 25 are operable to maintain the rotation ring 22 in the position to which it has been moved. While a plurality of keepers 25 have been illustrated herein, it is contemplated within the scope of the present invention that as few as one keeper 25 could be utilized to execute the desired functionality as described herein.

The second receptacle 30 includes rotation ring 32 having notches 33 formed therein and is identically operable as the rotation ring 22 of the first receptacle 20. The second receptacle 30 includes a plurality of keepers 35 that are also identical to the keepers 25 of the first receptacle 20. Both the first receptacle 20 and second receptacle 30 include receiving slots 40 that are conventional receiving slots operable to mateably couple with a standard electrical plug.

Figure 2:
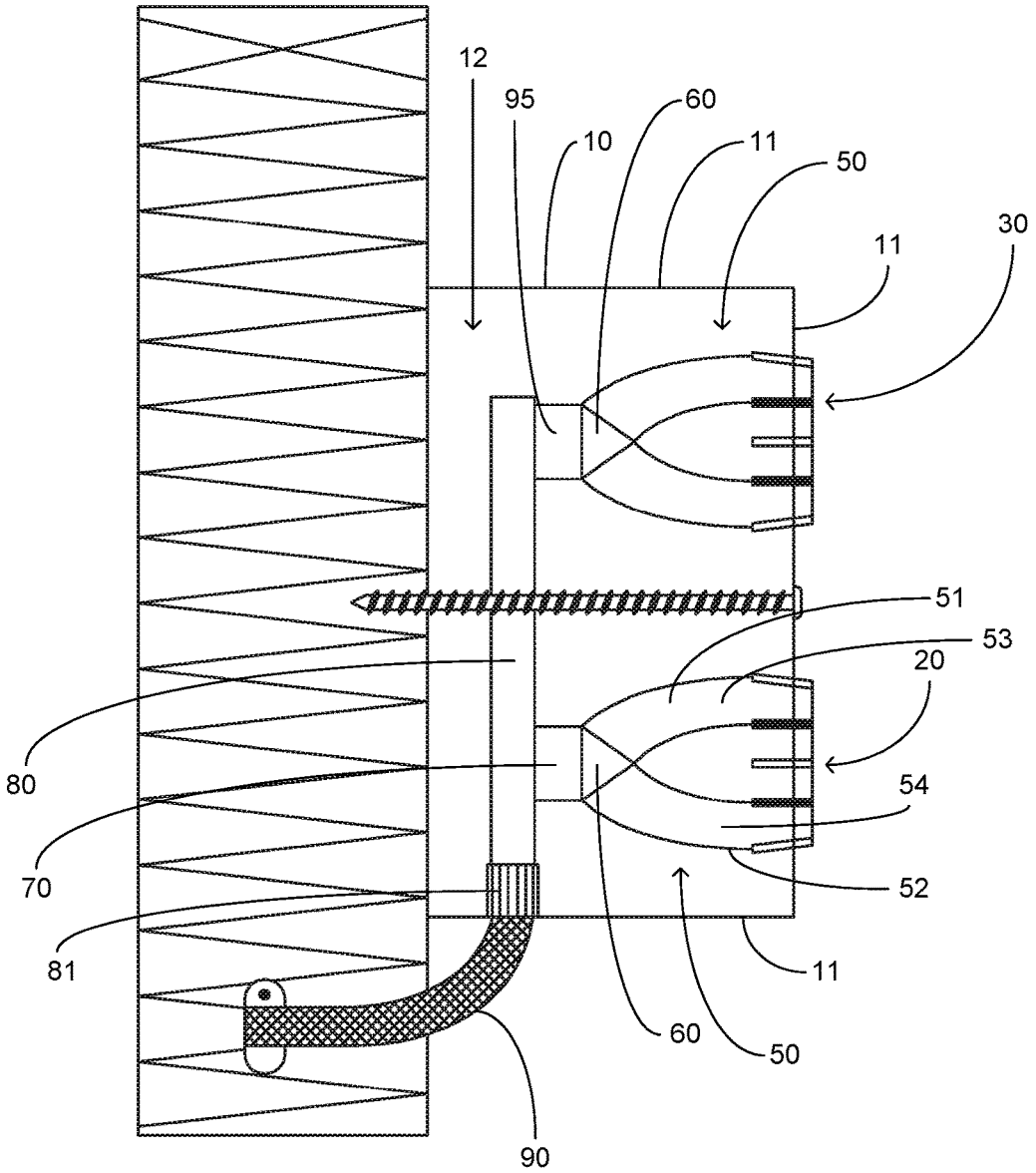
FIG. 2 is a side diagrammatic view of the electrical outlet of the present invention.

Now referring in particular to FIG. 2 herein, a cross-sectional view of the electrical outlet 100 is illustrated therein. The first receptacle 20 includes connection assembly 50 that is operable to facilitate the electrical coupling of the first receptacle 20 with conducting bar 80 and first connection member 70. The connection assembly 50 includes a first tube member 51 and a second tube member 52. The first tube member 51 and second tube member 52 include hollow passage 53,54 respectively. The first tube member 51 and second tube member 52 are manufactured from a durable insulative rigid material and are designed to maintain their shaped form as the first receptacle 20 is rotatably moved to desired positions. The first tube member 51 and second tube member 52 are operably coupled to union 60. Union 60 is manufactured from a suitable conductive material such as but not limited to copper. Conventional electric wiring (not illustrated herein) is journaled through the first tube member 51 and second tube member 52 so as to electrically couple the receiving slots 40 and the union 60. It should be understood by those skilled in the art that the electric wiring present is the conventional configuration wherein a hot wire, neutral wire (return) and ground wire are disposed within the first tube member 51 and second tube member 52. It should also be understood that it is contemplated within the scope of the present invention that various configurations of wiring are within the scope of the present invention such as but not limited to additional hot wires for higher voltage configurations. Furthermore, it is contemplated within the scope of the present invention that the electrical wiring could be routed through the first tube member 51 and second tube member 52 in various configurations. The construction and configuration of the connection assembly 50 inhibits the tangling and/or deformation to the electrical wiring that may occur during rotation of the first receptacle 20. While a first tube member 51 and second tube member 52 are illustrated and discussed herein, an alternative embodiment of the connection assembly 50 is contemplated within the scope of the present invention. It is further contemplated within the scope of the present invention that the connection assembly could be formed from heavy gauge wire so as to avoid the requirement for the first tube member 51 and second tube member 52. In this contemplated alternative embodiment, the electrical wiring is formed in a shape similar to the shape illustrated herein for the first tube member 51 and second tube member 52. The receiving slots 40 are electrically coupled to the union 60 utilizing the heavy gauge wire and the gauge of the wire inhibits damage thereto during rotation of the first receptacle 20.

The union 60 is adjacent to and electrically coupled with the first connection member 70. The first connection member 70 is integrally formed with the conducting bar 80 and is manufactured from a suitable conductive material such as but not limited to copper. The union 60 sits adjacent the first connection member 70 and facilitates the maintenance of an electrical connection during rotation of the first receptacle 20. As the first receptacle 20 is rotated, the union 60 rotates and stays engaged with the first connection member 70 so as to maintain electrical current to the first receptacle 20. The conducting bar 80 is a solid copper bar and is electrically coupled with supply wire 90. The conducting bar 80 includes slots 81 formed therein wherein the slots 81 are configured to frictionally engage and maintain therein ends of the supply wire 90. While the slots 81 have been disclosed herein as being a technique to electrically couple the supply wire 90 to the conducting bar 80, it is contemplated within the scope of the present invention that the supply wire 90 could be operably coupled to the conducting bar 80 utilizing alternate techniques.

The second receptacle 30 is configured identically as described herein for the first receptacle 20 having a connection assembly 50 and union 60 configured to be electrically coupled to the second connection member 95. The second receptacle 30 functions identically to the first receptacle 20 as described herein.

The housing 10 is mountable to a support surface such as but not limited to a conventional wood stud 99 utilizing fastener 5. It is contemplated within the scope of the present invention that the housing 10 could be mounted utilizing various techniques and/or fasteners in a desired location of a structure either internally or externally.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An electrical outlet comprising:

a housing, said housing having a plurality of walls, said plurality of walls being integrally formed to create an interior volume, said housing having a front wall;

a first receptacle, said first receptacle having a rotation ring, said rotation ring configured to provide rotatable movement of said first receptacle, said first receptacle having receiving slots configured to mateably couple with an electrical plug, said first receptacle further including a connection assembly, said connection assembly being operably coupled to a union, said connection assembly electrically coupling said first receptacle to said union, said connection assembly configured to maintain a consistent shape during rotation of said first receptacle;

a second receptacle, said second receptacle having a rotation ring, said rotation ring of said second receptacle configured to provide rotatable movement of said second receptacle, said second receptacle having receiving slots configured to mateably couple with an electrical plug, said second receptacle further including a connection assembly, said connection assembly of said second receptacle being operably coupled to a union, said connection assembly of said second receptacle electrically coupling said second receptacle to said union of said second receptacle, said connection assembly of said second receptacle configured to maintain a consistent shape during rotation of said second receptacle;

a conducting bar, said conducting bar being mounted within the interior volume of said housing, said conducting bar configured to be electrically coupled to said union of said first receptacle and said union of said second receptacle.

2. The electrical outlet as recited in claim 1, wherein said rotation ring of said first receptacle further includes a plurality of notches.

3. The electrical outlet as recited in claim 1, wherein said rotation ring of said second receptacle further includes a plurality of notches.

4. The electrical outlet as recited in claim 3, and further including at least two keepers, wherein one of said at least two keepers is engaged with said rotation ring of said first receptacle and said rotation ring of said second receptacle.

5. The electrical outlet as recited in claim 4, and further including a first connection member, said first connection member being electrically intermediate said union of said first receptacle and said conducting bar, said first connection member facilitating the electrical coupling of said union of said first receptacle to said conducting bar.

6. The electrical outlet as recited in claim 5, and further including a second connection member, said second connection member being electrically intermediate said union of said second receptacle and said conducting bar, said second connection member facilitating the electrical coupling of said union of said second receptacle to said conducting bar.

7. The electrical outlet as recited in claim 6, wherein said conducting bar includes a first end and a second end, said conducting bar having a plurality of slots being formed in the first end thereof.

8. An electrical outlet that is configured with rotatable receptacles operable to facilitate the accommodation of large electrical plugs simultaneously comprising:

a housing, said housing having a plurality of walls, said plurality of walls being integrally formed to create an interior volume, said housing having a front wall;

a first receptacle, said first receptacle having a rotation ring, said rotation ring configured to provide rotatable movement of said first receptacle, said first receptacle having receiving slots configured to mateably couple with an electrical plug, said first receptacle further including a connection assembly, said connection assembly being operably coupled to a union, said connection assembly having a first tube member and a second tube member, said first tube member and said second tube member having a hollow passage, said hollow passage configured to have electrical wires journaled therethrough, said connection assembly electrically coupled to said union, said connection assembly configured to maintain a consistent shape during rotation of said first receptacle;

a second receptacle, said second receptacle having a rotation ring, said rotation ring of said second receptacle configured to provide rotatable movement of said second receptacle, said second receptacle having receiving slots configured to mateably couple with an electrical plug, said second receptacle further including a connection assembly, said connection assembly of said second receptacle being operably coupled to a second union, said connection assembly of said second receptacle having a first tube member and a second tube member, said first tube member and said second tube member of said connection assembly of said second receptacle having a hollow passage, said hollow passage of said connection assembly of said second receptacle configured to have electrical wires journaled therethrough, said connection assembly of said second receptacle electrically coupled to said second union, said connection assembly of said second receptacle configured to maintain a consistent shape during rotation of said second receptacle; and a conducting bar, said conducting bar being mounted within the interior volume of said housing, said conducting bar having a first end and a second end, said conducting bar configured to be electrically coupled to said union of said first receptacle and said union of said second receptacle.

9. The electrical outlet as recited in claim 8, wherein said rotation ring of said second receptacle is operable to provide incremental rotational movement of said second receptacle, said rotation ring of said second receptacle having a plurality of notches formed thereon.

10. The electrical outlet as recited in claim 9, wherein said second receptacle further includes at least one keeper, said at least one keeper being configured to engage said plurality of notches of said rotation ring of said second receptacle.

11. The electrical outlet as recited in claim 10, wherein said rotation ring of said first receptacle is operable to provide incremental rotational movement of said first receptacle, said rotation ring of said first receptacle having a plurality of notches formed thereon.

12. The electrical outlet as recited in claim 11, wherein said first receptacle further includes at least one keeper, said at least one keeper of said first receptacle being configured to engage said plurality of notches of said rotation ring of said first receptacle.

13. The electrical outlet as recited in claim 12, said conducting bar including a plurality of slots being formed in the first end thereof, said plurality of slots configured to couple with a supply wire.

14. The electrical outlet as recited in claim 13, and further including a first connection member, said first connection member being electrically intermediate said union of said first receptacle and said conducting bar, said first connection member facilitating the electrical coupling of said union of said first receptacle to said conducting bar.

15. The electrical outlet as recited in claim 14, and further including a second connection member, said second connection member being electrically intermediate said union of said second receptacle and said conducting bar, said second connection member facilitating the electrical coupling of said union of said second receptacle to said conducting bar.

16. An electrical outlet that is configured with rotatable receptacles operable to facilitate the accommodation of large electrical plugs simultaneously comprising:

a housing, said housing having a plurality of walls, said plurality of walls being integrally formed to create an interior volume, said housing having a front wall;

a first receptacle, said first receptacle having a rotation ring, wherein said rotation ring of said first receptacle is operable to provide incremental rotational movement of said first receptacle, said rotation ring of said first receptacle having a plurality of notches formed thereon, said first receptacle having receiving slots configured to mateably couple with an electrical plug, said first receptacle further including a connection assembly, said connection assembly being operably coupled to a union, said connection assembly having a first tube member and a second tube member, said first tube member and said second tube member having a hollow passage, said hollow passage configured to have electrical wires journaled therethrough, said connection assembly electrically coupled to said union, said connection assembly configured to maintain a consistent shape during rotation of said first receptacle;

a second receptacle, said second receptacle having a rotation ring, wherein said rotation ring of said second receptacle is operable to provide incremental rotational movement of said second receptacle, said rotation ring of said second receptacle having a plurality of notches formed thereon said second receptacle having receiving slots configured to mateably couple with an electrical plug, said second receptacle further including a connection assembly, said connection assembly of said second receptacle being operably coupled to a second union, said connection assembly of said second receptacle having a first tube member and a second tube member, said first tube member and said second tube member of said connection assembly of said second receptacle having a hollow passage, said hollow passage of said connection assembly of said second receptacle configured to have electrical wires journaled therethrough, said connection assembly of said second receptacle electrically coupled to said second union, said connection assembly of said second receptacle configured to maintain a consistent shape during rotation of said second receptacle;

a conducting bar, said conducting bar being mounted within the interior volume of said housing, said conducting bar having a first end and a second end, said conducting bar configured to be electrically coupled to said union of said first receptacle and said union of said second receptacle;

a first connection member, said first connection member being electrically intermediate said union of said first receptacle and said conducting bar, said first connection member facilitating the electrical coupling of said union of said first receptacle to said conducting bar; and a second connection member, said second connection member being electrically intermediate said union of said second receptacle and said conducting bar, said second connection member facilitating the electrical coupling of said union of said second receptacle to said conducting bar.

17. The electrical outlet as recited in claim 16, wherein said first receptacle further includes at least one keeper, said at least one keeper of said first receptacle being configured to engage said plurality of notches of said rotation ring of said first receptacle.

18. The electrical outlet as recited in claim 16, wherein said second receptacle further includes at least one keeper, said at least one keeper being configured to engage said plurality of notches of said rotation ring of said second receptacle.

19. The electrical outlet as recited in claim 18, wherein said conducting bar includes a plurality of slots being formed in the first end thereof, said plurality of slots configured to couple with a supply wire.

20. The electrical outlet as recited in claim 19, wherein said union of said first receptacle and said second receptacle in manufactured from copper.

* * * * *